United States Patent [19]

Musser

[11] 4,170,856

[45] Oct. 16, 1979

[54] METAL ENCASED REFRACTORY BRICK

[75] Inventor: John J. Musser, Kansas City, Mo.

[73] Assignee: Geo. P. Reintjes Co., Inc., Kansas City, Mo.

[21] Appl. No.: 890,609

[22] Filed: Mar. 20, 1978

[51] Int. Cl.[2] ..... E04C 2/04

[52] U.S. Cl. ..... 52/598; 52/612; 110/340

[58] Field of Search ..... 52/596–612; 110/340

[56] References Cited

U.S. PATENT DOCUMENTS

| | | | |
|---|---|---|---|
| 3,073,067 | 1/1963 | Shonkwiler | 110/340 X |
| 3,181,486 | 5/1965 | King | 110/340 |
| 3,205,842 | 9/1965 | Usmiani | 110/340 |
| 3,213,533 | 10/1965 | Lynam et al. | 52/598 X |
| 3,252,436 | 5/1966 | Hall | 110/340 X |
| 3,280,772 | 10/1966 | Burklo | 110/340 |
| 3,287,872 | 11/1966 | Focht | 52/598 |
| 3,566,571 | 3/1971 | Stein | 52/598 |

FOREIGN PATENT DOCUMENTS

| | | | |
|---|---|---|---|
| 1251356 | 12/1960 | France | 110/340 |

*Primary Examiner*—J. Karl Bell

*Attorney, Agent, or Firm*—Schmidt, Johnson, Hovey & Williams

[57] ABSTRACT

A refractory brick unit is disclosed which is resistant to heat induced expansion spalling by virtue of the provision of a metallic sleeve member around four sides of the brick body with the metallic envelope being constructed in a manner such that two adjacent side sections thereof are spaced from proximal side walls of the brick and supported in such disposition by elongated tabs integral with the sleeve member side sections and slidably received in complemental elongated depressions therefor in the opposed sidewall of the brick body. When the brick units are laid in side-by-side relationship with one side of a corresponding metallic side section abutting the side section of a proximal brick unit, the sleeve members as well as the brick units are able to undergo heat induced expansion without placing compression loads on the bricks which could cause spalling of the brick bodies.

12 Claims, 4 Drawing Figures

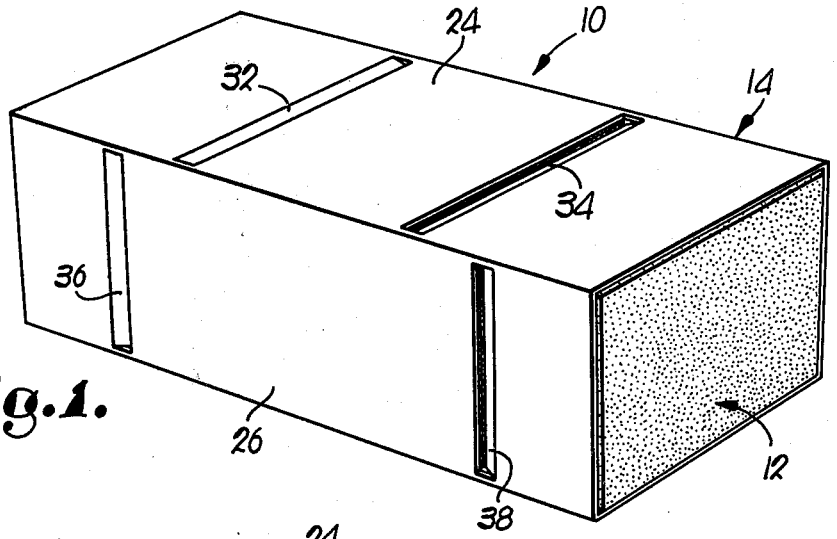
Fig. 1.
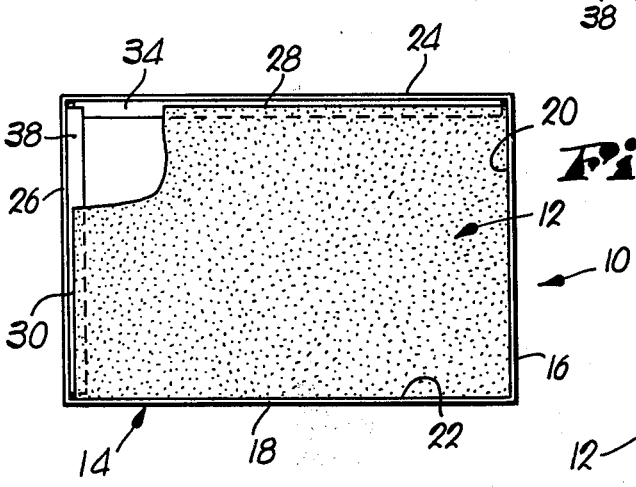
Fig. 2.
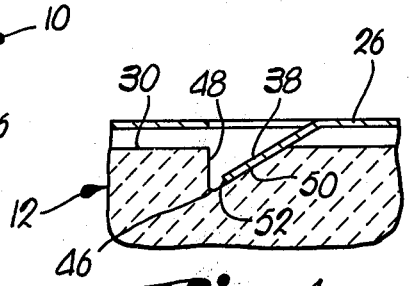
Fig. 4.
Fig. 3.
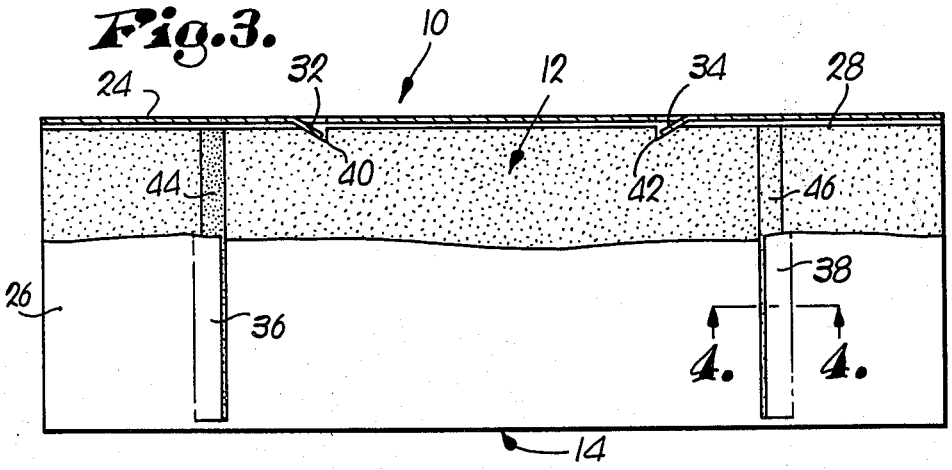

METAL ENCASED REFRACTORY BRICK

TECHNICAL FIELD

This invention relates to a metallic sleeve encased refractory brick and especially to bricks which may be laid side-by-side without attendent heat induced expansion spalling thereof as has heretofore been a problem in the absence of expensive constructional features to accommodate expansion of the brick bodies. The refractory bricks of this invention are usable in various refractory applications such as open hearth as well as electric furnaces.

BACKGROUND ART

It has long been the practice in the construction of refractory kilns or furnaces and particularly high temperature units employed for metallurgical purposes, to fabricate the enclosure with heat resistant brick bodies partially or totally encased in a sheet metal envelope of sleeve. These brick bodies may be of various shapes with rectangular bricks, for example, being used in structures such as open hearth furnaces while tapered bricks are generally employed in refractory designs for electric furnaces.

U.S. Pat. No. 3,287,872 shows and describes one type of metal encased refractory brick wherein the encasing metal is mechanically attached to the brick body in surrounding relationship thereto. In the structure of this patent, segments of the casing extend inwardly from the metal jacket to provide for expansion and oxidation of the steel, but the assembly is expensive to manufacture, and has limited, if any, ability to prevent heat induced expansion spalling of the brick bodies since the latter are totally encased within sidewalls which engage all surfaces of the brick. As a consequence, when the encased bricks are laid in side-by-side relationship, there is still some tendency for the units to be subjected to undue compression load during heat induced expansion.

The same is true of the refractory brick shown and described in U.S. Pat. No. 3,566,571 wherein a brick body is enclosed within a metal casing having a series of dimples or spacing portions which engage respective brick walls either within complementary depressions therefor, or a planar sidewall of the brick. Here again, even though parts of the side sections of the metal casing are spaced from the adjacent wall surface of the refractory brick body, the dimples or spacing portions which are in engagement with the brick can exert compression forces thereon which are capable of inducing spalling during high temperature operations of the refractory constructed from such brick. Furthermore, manufacture of a brick as depicted and described in the U.S. Pat. No. 3,556,571 is relatively expensive and limits the market for such assemblies.

In U.S. Pat. No. 1,883,983, an attempt is made to thwart expansion spalling of brick by providing an asbestos filler material between adjacent brick bodies. Although this method may be effective in certain applications, the cost factor has militated against significant use thereof, particularly when the cost of installation of the brick is taken into account.

DISCLOSURE OF INVENTION

The metal encased refractory brick of this invention comprises a rectangular cubic brick body having straight or tapered sidewalls which is partially enclosed within a tubular metallic sleeve member wherein in the preferred form, two adjacent side sections of the sleeve are spaced from corresponding opposed sidewall surfaces of the brick body to allow expansion of the sleeve as well as the brick body itself when refractories are placed in side-by-side relationship, without spalling of the brick. Each of the side sections of the metal enclosure which are spaced from respective sidewalls of the brick body are provided with integral, elongated tabs displaced from the main sidewall section of the metal sleeve in a direction to be received within depressions therefor formed in the adjacent sidewall of the brick body. The depressions are of V-shaped configuration having one surface perpendicular to the plane of the sidewall of the body, along with an inclined depression defining wall surface which complementally receives an angular tab bent out of the plane of the wall section of the encasing sleeve. The free ends of each of the tabs terminate in spaced relationship from the bottom of each of the V depressions so that heat induced expansion of the components of the refractory do not result in exertion of compression forces on the brick body itself which could cause spalling or degeneration thereof in any way. Furthermore, the tabs are nearly the same width as the transverse dimension of the brick body engaged thereby thus providing sufficient strength to hold the brick body and metallic casing together and at the same time prevent the space between the casing sleeve and the refractory from becoming a chimney of sufficient size to allow an excessive amount of gases in the furnace to escape.

BRIEF DESCRIPTION OF DRAWINGS

FIG. 1 is a perspective view of a metal encased refractory brick constructed in accordance with the preferred concepts of the present invention and showing the two major sides thereof which have tabs bent out of the main plane of the side sections of a tubular metallic sleeve for interlock within complemental depressions therefor in the corresponding opposed sidewalls of the brick body;

FIG. 2 is an end elevational view of the metal encased refractory brick as shown in FIG. 1, with a portion of the brick body being broken away to more fully illustrate the interrelationship of the interlocking tabs and depressions provided therein;

FIG. 3 is a side elevational view from the left side of the brick unit as shown in FIG. 2, with portions of the structure again being broken away to more clearly reveal details of construction of the assembly; and FIG. 4 is an enlarged fragmentary horizontal cross-sectional view taken substantially on the line 4—4 of FIG. 3 and looking in the direction of the arrows.

BEST MODE FOR CARRYING OUT THE INVENTION

The metal encased refractory brick illustrated in the drawings is broadly designated by the numeral 10 and includes as its primary components, a refractory brick body 12 partially encased within a metallic sleeve 14. Heat resistant refractory body 12 is illustrated as being of rectangular cubic configuration having four long sidewalls and two smaller rectangular ends, but it is to be appreciated that such body may be of other conventional shapes as now used in the refractory industry. For example, although the brick 10 as illustrated may have especial utility in the fabrication of refractory furnaces such as those of the open hearth design, tapered bricks may also be fabricated in accordance with the invention for use in constructing electric furnace structures.

In the preferred embodiment depicted in the drawings, metallic sleeve 14 is of steel of the type commonly used in production of metal encased refractory units, and comprises a rectangular structure which is disposed in circumscribing relationship to the four major sidewall surfaces of the brick body 12. The two rectangular sidewall sections 16 and 18 of sleeve 14 are fabricated to overlie and complementally engage the corresponding opposed rectangular sidewalls 20 and 22 respectively of brick body 12.

The other two rectangular sections 24 and 26 of metallic sleeve 14 are slightly larger than the corresponding opposed sidewalls 28 and 30 of brick body 12. As a consequence, the side sections 24 and 26 are spaced from sidewalls 28 and 30 of brick body 12 to an extent to allow heat induced expansion of body 12 without placing damaging compression forces thereon when a series of bricks 10 are placed in side-by-side relationship. Although the exact space to be provided between side sections 24 and 26, and adjacent sidewalls 28 and 30 of brick body 12 is variable as desired for a particular application, it has been found that a suitable dimension in this respect is approximately one-sixteenth inch (0.16 cm.).

Extension means is provided for interlocking the metal sleeve and the brick body 12 notwithstanding the space between side sections 24 and 26, and corresponding opposed sidewalls 28 and 30 of brick body 12. The extension means functions to not only retain the sleeve on the refractory, but also provides support for the wall sections of the sleeve which are spaced from opposed sidewalls of the refractory block.

In its preferred form, the interlocking extension means comprises a pair of integral, elongated tabs 32 and 34 displaced from the main plane of side section 24 of metallic sleeve 14, as well as a pair of integral, elongated tabs 36 and 38 which are bent inwardly from the main plane of section 26 of the sleeve 14. As is most evident from FIGS. 3 and 4, the sidewall 28 of brick body 12 has a pair of V-shaped depressions 40 and 42 therein which receive tabs 32 and 34 respectively, while V-shaped depressions 44 and 46 in sidewall 30 of brick body 12 are located to complementally receive tabs 36 and 38 displaced from the plane of sleeve section 26.

Viewing FIGS. 1, 2 and 3, it can be seen that the V-depressions 40 to 46 inclusive extend transversely the full width of respective sidewalls 28 and 30 of brick body 12 but that tabs 32 to 38 inclusive terminate in slightly spaced relationship from corresponding side edges of the walls 24 and 26 of metallic sleeve 14. Also, it is to be observed from the drawings that each of the V-shaped depressions 40 to 46 inclusive is defined by an indented surface 48 in generally perpendicular relationship to a corresponding sidewall 28 or 30, along with an inclined indented surface 50 which is at an acute angle with respect to surface 48 to thereby define a corresponding groove extending transversely of the brick body. An upright depression defining surface thus merges with a smoothly inclined indented surface. The tabs 32 to 38 inclusive bent out of the main plane of sidewall sections 24 and 26 of metallic sleeve 14 are displaced from corresponding sections at an angle to complementally engage indented surfaces 50 of depressions 40 to 46 inclusive as is best illustrated in FIG. 4. It can also be seen from this figure that the depressions 40 to 46 inclusive are of a depth such that the free ends 52 of tabs 32 to 38 inclusive terminate in spaced relationship from the line of merger of indented surfaces 48 and 50 of respective depressions 40 to 46. As a result, the brick body 12 may expand as necessary without tabs 32 to 38 exerting undue pressure on the refractory.

Again referring to the preferred embodiment of the invention, it has been found desirable to deflect tabs 32 and 34 of metallic sleeve section 24 in opposite directions toward each other as best shown, for example, in FIG. 3, while tabs 36 and 38 are also displaced out of the plane of side section 26 of sleeve 14 in opposite directions toward each other as can be seen in FIG. 1. In such preferred embodiment, the tabs 36 and 38 are located outboard of the tabs 32 and 34. This offset relationship of the tabs on one side of the metallic sleeve with respect to the tabs of the adjacent side thereof, results in more secure interlock of the sleeve 14 to brick body 12 and further minimizes any tendency for gases in a furnace built from brick 10 to be lost by a chimney effect through the spaces between two opposed sidewalls of the brick body 12 and the encasing sleeve 14. In addition, by offsetting the tabs, there is less tendency for the strength of the sleeve to be decreased by bending of a portion of the material out of the main plane thereof, and the overall physical properties of the brick 10 are thereby retained without sacrifice in the structural integrity of the assembly, or its resistance to heat in service. Finally, there is no tendency for the brick body to rupture or break along the lines presented by the offset grooves in two faces thereof.

INDUSTRIAL APPLICABILITY

Brick 10 is useful for fabricating a variety of refractory structures such as open hearth or electrical furnaces and especially lends itself to applications where the brick bodies are subjected to sufficiently high temperatures that they would undergo compression spalling if the ceramic bodies were placed in direct side-by-side-interengaging relationship. Tabs 32 to 38 inclusive interlocked with V-depressions 40 to 46 inclusive prevent the metallic sleeve casing from slipping off of the refractory body 12 and at the same time do not interfere with the air space provided between adjacent sidewalls 28 and 30 which are away from corresponding side sections 24 and 26. In this way, build up of pressure between refractory bricks 10 placed in side-by-side relationship is precluded which would otherwise result in spalling of the refractory material.

Since tabs 32 to 38 inclusive are nearly the same width and/or depth as the brick body 12, they provide sufficient strength to hold the refractory body 12 and casing sleeve 14 together. The length of the tabs 32 to 38 inclusive has also been found to be sufficient to prevent the depressions 40 to 46 inclusive as well as the space between sections 24 and 26 from sidewalls 28 and 30 from becoming a chimney of great enough size to allow an excessive amount of furnace gases to escape. Of particular significance in this respect is the fact that the small space between the brick body and the sleeve constantly becomes smaller as they are heated by the furnace gases.

Although the preferred embodiment as shown has tabs on two sides of the brick 10, it can be appreciated that if desired, such tabs can be employed on only one surface of the brick, or on more than two sides for particular applications. Furthermore, the direction of displacement of tabs 32 to 38 inclusive is not critical and could be opposite of that illustrated. Finally, more than two depressions and associated tabs may be provided on each side of the brick for more effective interlocking and to provide additional support to the side sections of the sleeve 14 spaced from adjacent sidewalls of the brick body 12.

Having thus described the invention, what is claimed as new and desired to be secured by Letters Patent is:

1. A refractory brick unit resistant to heat induced expansion spalling comprising:

a heat resistant brick body having at least one sidewall which is adapted to be disposed adjacent the side of another proximal brick in refractory construction; and a metallic member having at least a section thereof overlying said one sidewall of the brick body in at least partial covering relationship thereto and spaced from the face of said one sidewall, there being a plurality of elongated indented surfaces in said one sidewall of the brick body defining each of a plurality of spaced depressions therein, said brick body being provided with a pair of surfaces defining each of the depressions in said one sidewall thereof with one of said surfaces being in substantially perpendicular relationship to said one sidewall of the brick body while the other depression defining surface is inclined with respect to said one surface and said one sidewall of the brick body, said section of the metallic member being provided with extension means thereon projecting into each of the depressions, each of said extension means comprising an elongated tab integral with said section of the metallic member and having a free end which engages a corresponding inclined depression defining surface of the brick body in normally spaced relationship from said one surface proximal thereto, said extension means at least partially supporting said section of the metallic member in said spaced relationship from said one sidewall of the brick body whereby when the brick unit is laid side-by-side with another brick with the metallic section in abutting relationship to said other proximal brick, the space between the section of the metallic member and said one sidewall of the brick body accommodates expansion of the brick body during heating thereof without spalling attributable to pressure engagement with said other brick.

2. A brick unit as set forth in claim 1 wherein said metallic member comprises a sleeve in at least partial enveloping relationship to said brick body with said section comprising one side of the sleeve and spaced from said one sidewall of the brick body.

3. A brick unit as set forth in claim 1 wherein said metallic member includes first and second sections adjacent to and spaced from respective first and second sidewalls of the brick body, each of said sidewalls being provided with a plurality of elongated depressions therein and each section having extension means thereon projecting into and slidably engaging the surfaces of corresponding depressions in the brick body.

4. A brick unit as set forth in claim 3 wherein said sections are in adjacent, intersecting relationship and spaced substantially equal distances from corresponding sidewall of the brick body.

5. A brick unit as set forth in claim 1 wherein said brick body is of rectangular cubic configuration with said depressions being provided in a pair of adjacent intersecting rectangular sidewalls, said metallic member being of rectangular tubular shape in complemental overlying relationship with the rectangular brick body, the two side sections of said tubular metallic member overlying said pair of sidewalls of the brick body being spaced therefrom, there being a plurality of depressions in each of said pair of sidewalls and tabs extending from each of said two side sections into corresponding depressions in the two sidewalls.

6. A brick unit as set forth in claim 5 wherein the depressions in one of said two sidewalls and the tabs projecting thereinto are offset longitudinally of the brick body from the depressions in the other of said two sidewalls and the tabs extending into such depressions.

7. A brick unit as set forth in claim 1 wherein said extension means comprises elongated tabs bent from the main body of said section of the member and substantially coextensive in length with corresponding depression therefor.

8. A brick unit as set forth in claim 1 wherein said section of the metallic member is spaced from the sidewall of the brick unit approximately 1/16 inch.

9. A brick unit as set forth in claim 1 wherein said one sidewall is of rectangular configuration and a pair of depressions are provided therein extending transversely of the sidewall adjacent respective end margins of the sidewall.

10. A brick unit as set forth in claim 9 wherein each of said depressions is of generally V-shaped configuration and the extension means comprise planar tabs integral with said section of the metallic member and projecting into corresponding V depressions.

11. A brick unit as set forth in claim 10 wherein each of said V depressions is defined by a first surface indentation in the brick body disposed in essentially perpendicular relationship to said one sidewall thereof and a second surface indentation at an acute angle with respect to a corresponding first surface indentation, the second surface indentations of one depression facing in the opposite direction from the second surface indentation of the other depression.

12. A brick unit as set forth in claim 11 wherein said depressions and the tabs received therein extend substantially the full transverse width of said sidewall.

* * * * *